US005090125A

United States Patent [19]

Sogan

[11] Patent Number: 5,090,125

[45] Date of Patent: Feb. 25, 1992

[54] CUTTING TOOL

[76] Inventor: Donald J. Sogan, 305 Marlborough Turnpike, Portland, Conn. 06480

[21] Appl. No.: 714,558

[22] Filed: Jun. 13, 1991

[51] Int. Cl.[5] ..... B26B 23/00; B27L 7/00

[52] U.S. Cl. ..... 30/308.1; 144/193 D

[58] Field of Search ..... 30/DIG. 7, 308.1; 144/193 R, 193 C, 193 D

[56] References Cited

FOREIGN PATENT DOCUMENTS 185266 4/1956 Austria ..... 144/193 D

*Primary Examiner*—W. Donald Bray
*Attorney, Agent, or Firm*—Leon Gilden

[57] ABSTRACT

A cutting tool formed of ferrous steel includes an elongate blade plate with a coextensive lower sharpened terminal edge, with a blade plate mounted orthogonally to an upper terminal edge of the blade and a handle fixedly mounted to the blade plate. A guard is mounted at a rear terminal edge of the blade and blade plate in an orthogonal relationship. The blade plate accommodates impact to assist in splitting and cutting procedures. The invention may further include a guard housing arranged for reception of the blade utilizing a ferromagnetic strip to magnetically attract and secure a bottom surface of the blade plate to the guard, wherein the guard may be further formed with an oil reservoir conduit to direct lubricating of oil minimizing and preventing and corrosion of the blade edge to prolong its effective use.

5 Claims, 4 Drawing Sheets

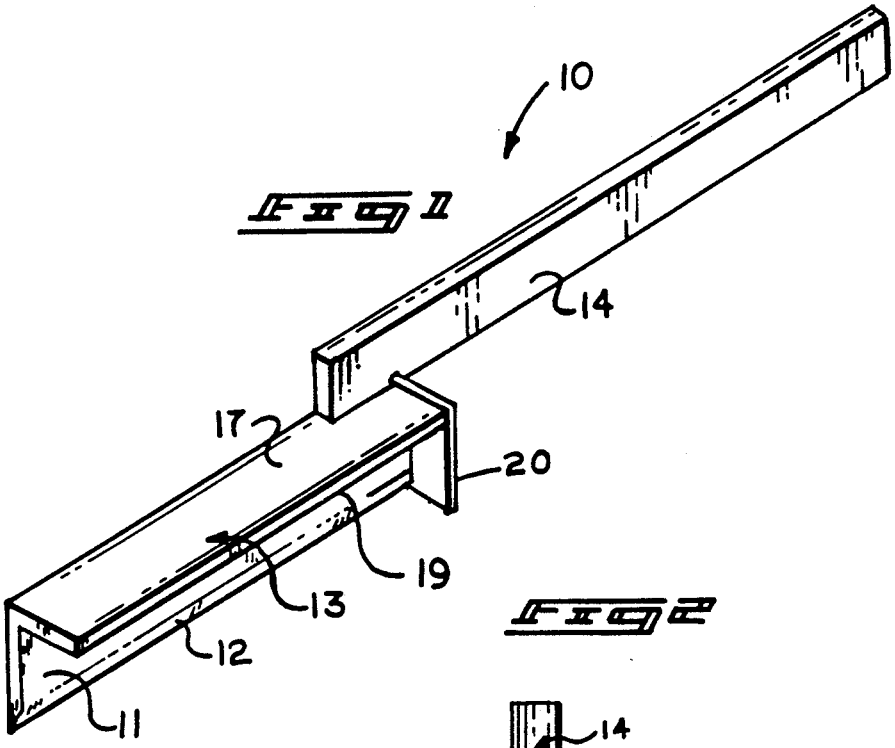
Fig 1
Fig 2
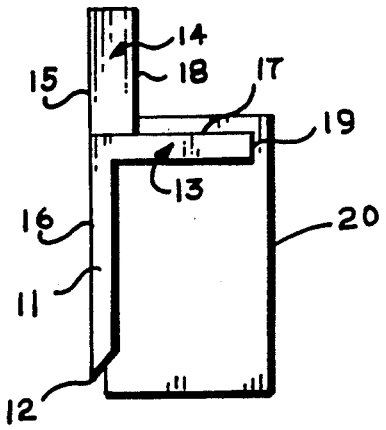
Fig 3
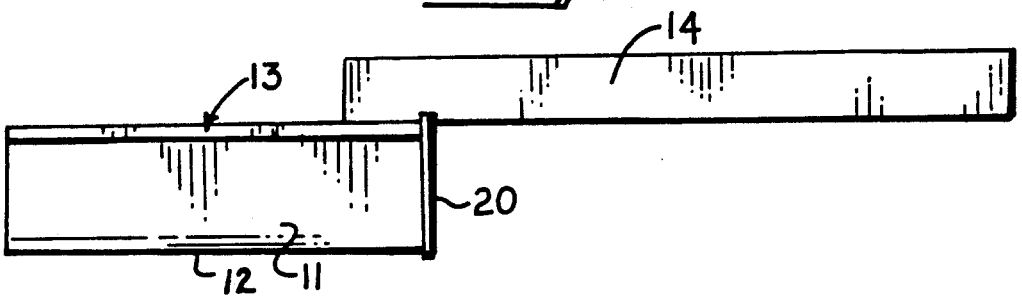

14
13
20
23
24
22
11
25
12
5
26
27
5

23
25
27
24
2
26
28

CUTTING TOOL

BACKGROUND OF THE INVENTION

1. Field of the Invention

The field of invention relates to cutting implements, and more particularly pertains to a new and improved cutting tool wherein the same is arranged and constructed for the cutting in various environments.

2. Description of the Prior Art

Cutting tools of various types are utilized in the prior art. Typically, individuals engaged in cutting and splitting wood, brush, and the like must resort to a plurality of implements. The instant invention attempts to overcome deficiencies of the prior art by providing a single implement of unitary construction arranged to accommodate various cutting situations. Prior art cutting implements to accommodate various cutting situations are exemplified in U.S. Pat. No. 3,321,783 to Ivan wherein a single tool is provided with various components to provide for a hatchet, hammer, and knife organization available to an individual in use.

U.S. Pat. No. 4,412,572 to Clark sets forth a splitting ax arranged for use in splitting procedures.

U.S. Pat. No. 4,300,606 to Branson sets forth a wood splitting ax of a further configuration utilizing a novel positioning of the handle relative to the ax head.

U.S. Pat. No. 2,804,109 to Fatica sets forth a combination ax and hammer construction adjustably mounted relative to an associated handle.

U.S. Pat. No. 4,586,258 to Burke sets forth an ax formed with an ax head of a convex shape to accommodate splitting procedures.

As such, it may be appreciated that there continues to be a need for a new and improved cutting tool as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of cutting tool construction now present in the prior art, the present invention provides a cutting tool wherein the same is arranged to provide for a unitary cutting implement to accommodate cutting and provide for an impact receiving flange mounted to an upper edge of the cutting blade. As such, the general purpose of the present invention, which will be described subseguently in greater detail, is to provide a new and improved cutting tool which has all the advantages of the prior art cutting tools and none of the disadvantages.

To attain this, the present invention provides a cutting tool formed of ferrous steel including an elongate blade plate with a coextensive lower sharpened terminal edge, with a blade plate mounted orthogonally to an upper terminal edge of the blade and a handle fixedly mounted to the blade plate. A guard is mounted at a rear terminal edge of the blade and blade plate in an orthogonal relationship. The blade plate accommodates impact to assist in splitting and cutting procedures. The invention may further include a guard housing arranged for reception of the blade utilizing a ferromagnetic strip to magnetically attract and secure a bottom surface of the blade plate to the guard, Wherein the guard may be further formed with an oil reservoir conduit to direct lubricating of oil minimizing and preventing corrosion of the blade edge to prolong its effective use.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved cutting tool which has all the advantages of the prior art cutting tools and none of the disadvantages.

It is another object of the present invention to provide a new and improved cutting tool which may be easily and efficiently manufactured and marketed.

It is a further object of the present invention to provide a new and improved cutting tool which is of a durable and reliable construction.

An even further object of the present invention is to provide a new and improved cutting tool which is susceptible of a low cost of manufacture with regard to both materials and labor, and which accordingly is then susceptible of low prices of sale to the consuming public, thereby making such cutting tool economically available to the buying public.

Still yet another object of the present invention is to provide a new and improved cutting tool which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an isometric illustration of the cutting tool of the invention.

FIG. 2 is an orthographic end view of the cutting tool of the invention.

FIG. 3 is an orthographic side view of the cutting tool of the invention.

DESCRIPTION OF THE PREFERRED EMBODIMENT

Figure 4:
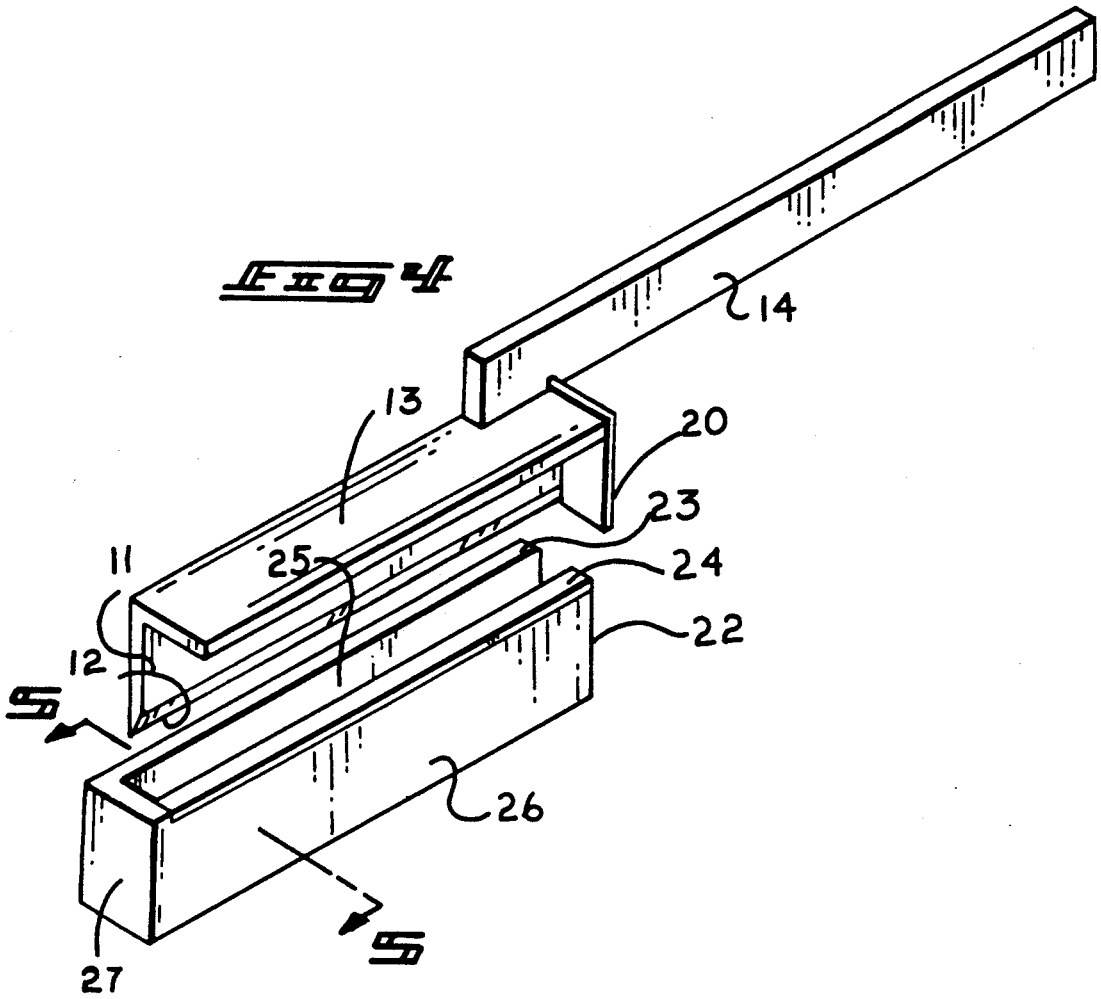
FIG 4 is an isometric illustration of the cutting tool utilized in association with a guard housing.

With reference now to the drawings, and in particular to FIGS. 1 to 9 thereof, a new and improved cutting tool embodying the principles and concepts of the present invention and generally designated by the reference numeral 10 will be described.

More specifically, the cutting tool 10 of the instant invention essentially comprises an elongate planar blade member 11, with an elongate blade edge 12 mounted coextensively to a lower terminal edge of the blade member 11, with the blade member 11 further including a force receiving blade plate 13 orthogonally and coextensively mounted to an upper terminal edge of the blade member 11 extending from the upper terminal edge laterally thereof to provide an "L" shaped configuration. A blade handle 14 is fixedly mounted to the top surface of the blade plate 13 and includes a blade handle exterior planar surface 15 coplanar with a blade flange exterior surface 16 of the blade member 11. The blade handle 14 extends rearwardly of the blade plate top surface and is orthogonally oriented relative to a guard plate member 20 that in turn is fixedly mounted to a rear terminal edge of the blade plate 13 and the blade member 11. The guard member 20 is defined as a plate and extends below the blade edge 12. The cutting member accordingly is of a unitary rigid metallic construction to accommodate shock during a variety of cutting procedures to include splitting and the like. It should be noted that the guard member 20 may be arranged either to extend to at least the blade plate outer edge 19 or possibly beyond, as illustrated in FIG. 2, to prevent inadvertent projection of an individual's hand about the blade member 11.

Figure 5:
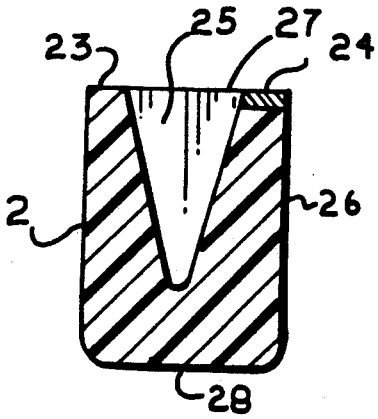
FIG. 5 is an orthographic view, taken along the lines 5—5 of FIG. 4 in the direction indicated by the arrows.

As illustrated in FIG. 4 for example, a guard housing 22 is provided defined by a housing first top wall 23 spaced from and in coplanar alignment with the housing second top wall 24. The second top wall 24 is formed of a ferromagnetic material to effect magnetic attraction to a bottom surface of the blade plate 13. The first and second top walls are also of a predetermined length, as is a "V" shaped groove 25 projecting between the top walls and between housing side walls 26 of the housing 22. The predetermined length of the "V" shaped groove is substantially equal to the predetermined length of the blade member 11 to completely receive the blade member therewithin, wherein a forward surface of the guard member 20 provides an abutment surface to engage a housing rear wall 29 defined with a "V" shaped entrance opening to receive the blade 11. The "V" shaped groove 25 projects into the housing and is spaced above the housing bottom wall 28, in a manner as illustrated in FIG. 5. When the blade 11 is positioned within the "V" shaped groove 25, the magnetic second top wall 24 magnetically attracts the blade plate 13 to enhance securement between the guard 22 and the blade plate 13.

Figure 6:
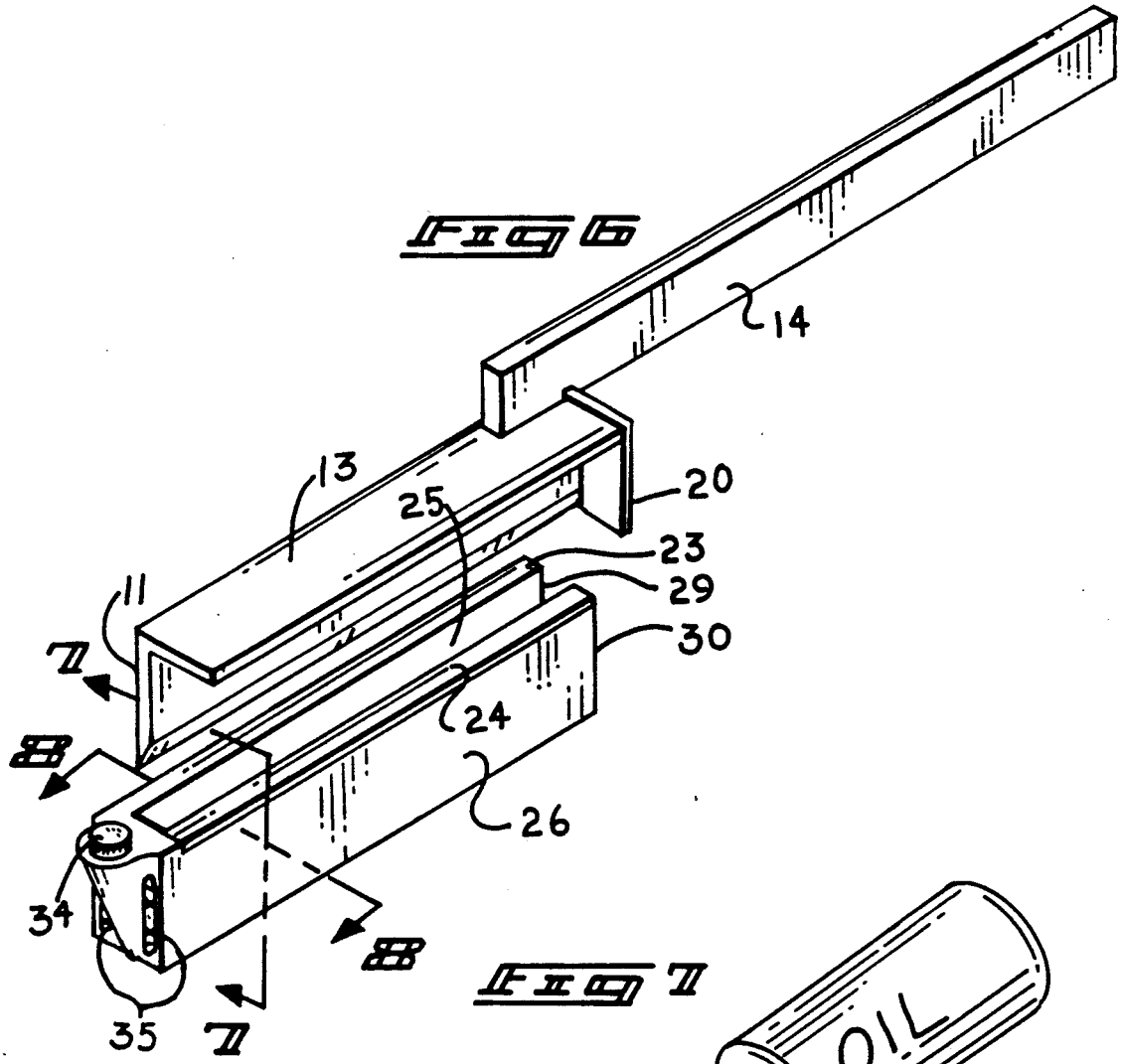
FIG. 6 is an isometric illustration of the cutting tool in association with a modified guard housing.
Figure 7:
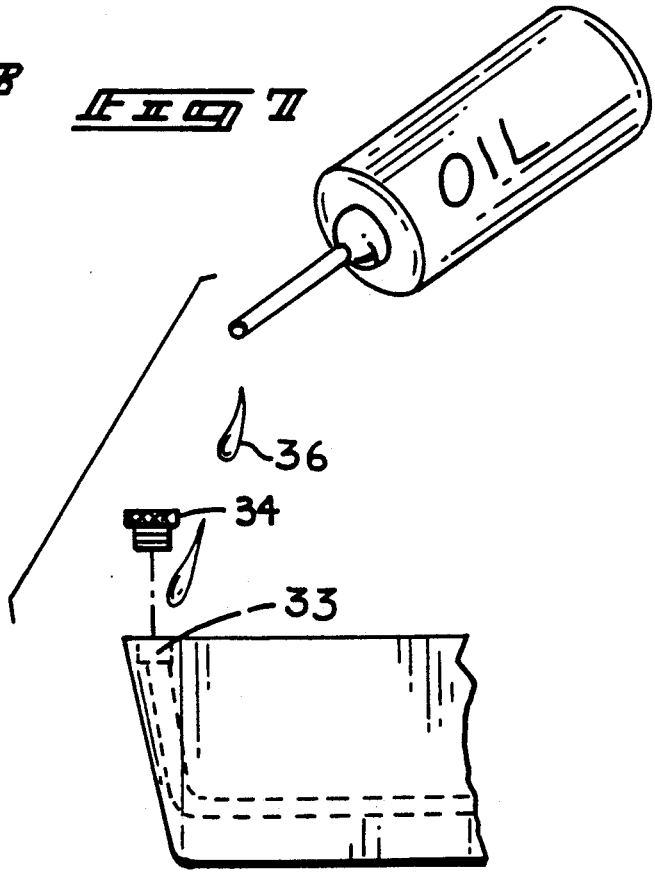
FIG. 7 is an orthographic view, taken along the lines 7—7 of FIG. 6 in the direction indicated by the arrows.
Figure 8:
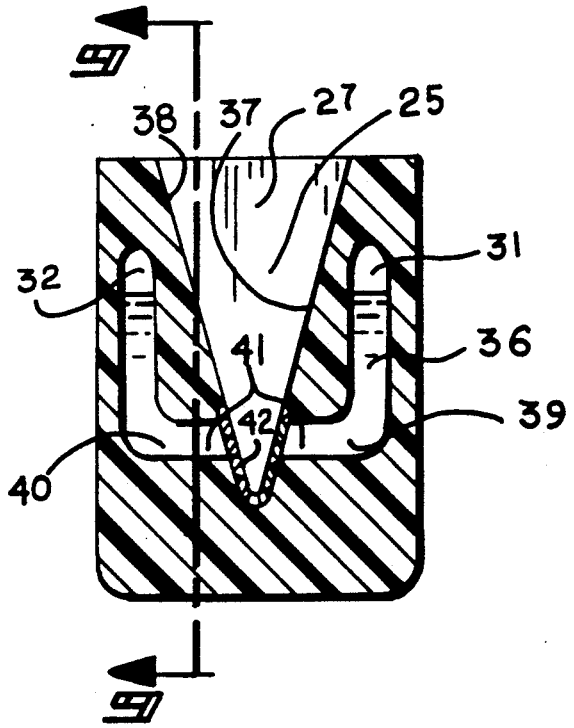
FIG. 8 is an orthographic view, taken along the lines 8—8 of FIG. 6 in the direction indicated by the arrows.
Figure 9:
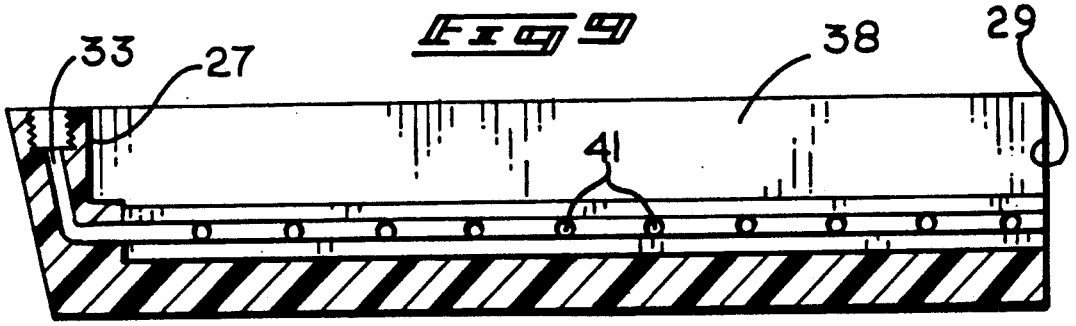
FIG. 9 is an orthographic view, taken along the lines 9—9 of FIG. 8 in the direction indicated by the arrows.

FIG. 6 illustrates a modified guard housing 30, including respective right and left lubricating oil reservoirs 31 and 32 extending coextensively between the "V" shaped groove and the respective side walls 26. Each right and left lubricating oil reservoir 31 and 32 are filled through a reservoir fill conduit 33 directed through the housing front wall 27 and includes a conduit cap 34 to seal the fluid therewithin. Transparent vertical side plates 35 are directed through the vertical front surface of the front wall 27 to provide visual location of lubricating oil 36 and its associated level within each respective reservoir. Each reservoir includes a respective right and left reservoir conduit 39 and 40 directed coextensively with and adjacent a bottom portion of each reservoir, with each reservoir conduit including a series of spaced feed apertures 41. The feed apertures direct lubricating oil into the respective right and left groove walls 37 and 38 (see FIG. 8) within the "V" shaped groove 25. A "V" shaped fluid permeable web 42 is mounted at a lower terminal end of the "V" shaped groove 25 extending from a lower apex of the groove 25 along each interior groove wall 37 and 38 to be positioned spaced above each associated series of feed apertures 41 to receive the cutting edge 12 within the fluid permeable web 42 that extends coextensively within the bottom portion of the groove 25 to impart corrosion resisting lubricating oil to the blade edge to maintain its sharpness and prolong effective use of the tool.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A cutting tool, comprising in combination, a tool member including a planar blade member, the planar blade member including a blade member lower terminal edge, with a blade edge coextensively formed to the blade member lower terminal edge, and the blade member including a blade member upper terminal edge, the blade member upper terminal edge including a force receiving blade plate orthogonally mounted to the blade member coextensively and integrally to the blade member upper terminal edge defining an "L" shaped configuration and a blade handle fixedly mounted to a top surface of the blade plate, the blade handle extending rearwardly of the blade plate, with the blade handle including a blade handle exterior planar surface, and the blade member including a blade member exterior surface, wherein the blade handle exterior planar surface is coplanar with the blade member exterior surface, and a guard plate member fixedly and orthogonally mounted to a rear terminal edge of the blade member, and fixedly mounted to a rear terminal edge of the blade plate, with the guard member extending below the blade edge, and the blade handle orthogonally oriented relative to the guard member.

2. An apparatus as set forth in claim 1 including a guard housing, the guard housing including a guard housing first top wall spaced from, coplanar, and coextensive with a second top wall, and the housing including spaced side walls, and a "V" shaped groove coextensive with the first top wall and the second top wall extending into the housing between the side walls, and a housing front wall fixedly and integrally mounted to the side walls and a forward edge of the first top wall and a further forward edge of the second top wall, and the "V" shaped groove defined by a predetermined length, and the blade member defined by a length equal to the predetermined length, and the guard member including a forward guard surface defining an abutment surface, and a housing rear wall, with the abutment surface arranged for contiguous communication with the housing rear wall when the blade member is positioned within the "V" shaped groove.

3. An apparatus as set forth in claim 1 wherein the second top wall is defined by a coextensive strip of ferromagnetic material, and the blade plate is formed of a ferrous material to effect magnetic attraction between the blade plate and the second top wall.

4. An apparatus as set forth in claim 3 wherein the housing front wall includes a reservoir fill conduit, and the housing includes a right lubricating oil reservoir and a left lubricating oil reservoir, wherein the "V" shaped groove defines a right groove wall and a left groove wall, the right lubricating oil reservoir positioned between the right groove wall and one of said side walls, and the left lubricating oil reservoir positioned between the left groove wall and a further one of said housing side walls, wherein each right and left lubricating oil reservoir is positioned adjacent a lower terminal apex portion of the "V" shaped groove spaced above a housing bottom wall defined by the guard housing, and the right reservoir conduit and the left reservoir conduit are each in fluid communication with the reservoir fill conduit, the reservoir fill conduit projecting through an upper end portion of the housing front wall and includes a removable fill conduit cap permitting filling of each reservoir conduit with a fluid, and the right reservoir conduit defines a lower end portion of a right reservoir, and the left reservoir conduit defines a lower end portion of a left reservoir.

5. An apparatus as set forth in claim 4 wherein the right reservoir conduit and the left reservoir conduit each include a plurality of spaced feed apertures in fluid communication between each reservoir conduit and a respective groove wall, and further including a "V" shaped fluid permeable web positioned within the apex of the "V" shaped groove coextensive with the "V" shaped groove and extending from the apex of the "V" shaped groove above the feed apertures in the right groove wall and the left groove wall to receive the blade edge within the fluid permeable web to impart the fluid to the blade edge.

* * * * *